United States Patent [19]

Cheng

[11] Patent Number: 4,755,796

[45] Date of Patent: Jul. 5, 1988

[54] KEYBOARD FOR MINIATURE DATA PROCESSING DEVICES

[76] Inventor: Peter S. C. Cheng, 5 Ross Street, Toronto, Ontario, M5T 1Z8

[21] Appl. No.: 907,002

[22] Filed: Sep. 15, 1986

[51] Int. Cl.[4] ..... H01H 3/04

[52] U.S. Cl. ..... 340/365 R; 200/330; 200/332; 200/153 T

[58] Field of Search ..... 340/711, 365 R; 200/329, 330, 332, 153 T, 5 A, 5 R; 368/69, 70, 185, 186, 187

[56] References Cited

U.S. PATENT DOCUMENTS

| | | | |
|---|---|---|---|
| 125,952 | 4/1872 | Hansen | 400/112 |
| D. 244,012 | 4/1977 | Cake et al. | D10/31 |
| 2,460,486 | 2/1949 | Blampain | 368/246 |
| 3,301,970 | 1/1967 | Harrold | 200/5 R |
| 3,414,682 | 12/1968 | Harrold | 379/359 |
| 4,055,755 | 10/1977 | Nakamura et al. | 364/705 |
| 4,077,200 | 3/1978 | Schneider | 368/69 |
| 4,092,821 | 7/1978 | Wirz | 368/69 |
| 4,120,036 | 10/1978 | Maeda et al. | 364/705 |
| 4,120,044 | 10/1978 | Harayda | 364/900 |
| 4,253,177 | 2/1981 | Hafner | 368/187 |
| 4,255,801 | 3/1981 | Ode et al. | 368/10 |
| 4,268,913 | 5/1981 | Nakagiri et al. | 368/10 |
| 4,434,340 | 2/1984 | Kondo | 200/332 |

FOREIGN PATENT DOCUMENTS

| | | |
|---|---|---|
| 53-313836 | 2/1978 | Japan . |
| 0604261 | 8/1978 | Switzerland . |

*Primary Examiner*—John W. Caldwell, Jr.
*Assistant Examiner*—Alvin Oberley
*Attorney, Agent, or Firm*—Kirschstein, Kirschstein, Ottinger & Israel

[57] ABSTRACT

A manual data entry keyboard includes a plurality of key assemblies, each having an elongated arm and a touch contact at an outer end region of a respective arm. The arms are movable between a retracted position and an extended position, in the latter of which the touch contacts are spaced apart from each other by distances sufficient to enable a user to engage one touch contact at a time without simultaneously engaging an adjacent touch contact. A synchronizer ring simultaneously moves all of the arms between the retracted and extended positions.

21 Claims, 4 Drawing Sheets

FIG. 7
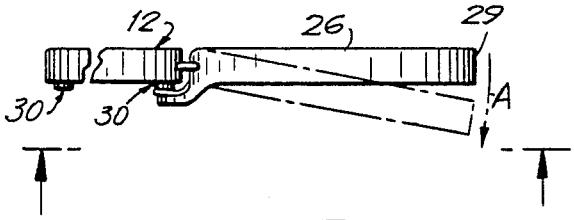
FIG. 8
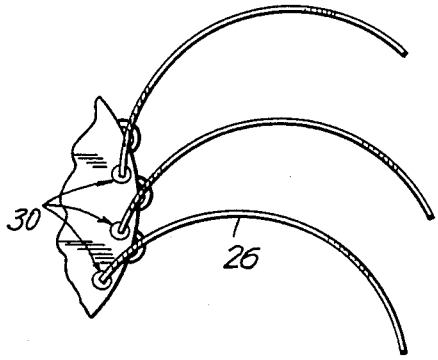
FIG. 10
FIG. 9
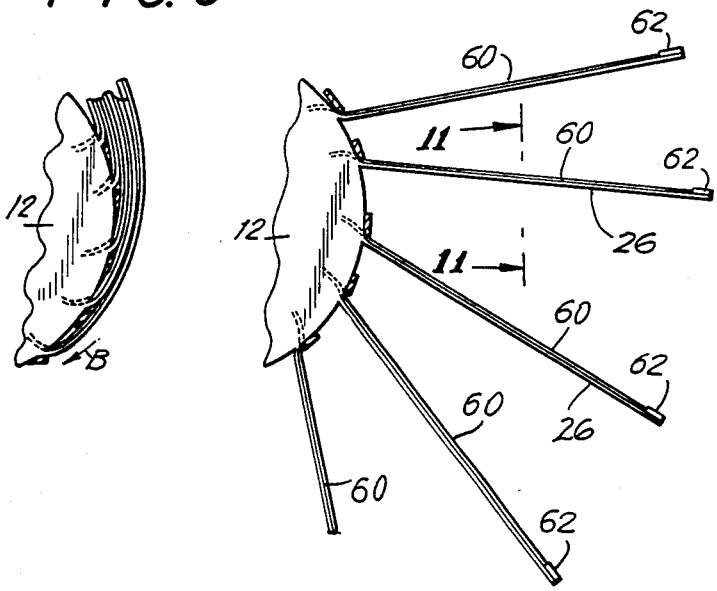
FIG. 11
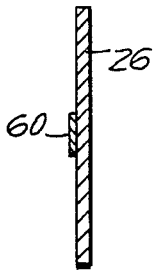

KEYBOARD FOR MINIATURE DATA PROCESSING DEVICES

BACKGROUND OF THE INVENTION

1. Field of the Invention

This invention generally relates to devices for processing data to be manually entered and, more particularly, to a keyboard for accurately and reliably manually entering data into devices of miniature dimensions.

2. Description of Related Art

Electronic data processing devices having manual entry keyboards for inputting data are, of course, well known. Although generally satisfactory for their intended purposes, experience has shown that when the individual keys are situated too close together, e.g. on the order of $\frac{5}{8}$" or less, often when a user uses his or her forefinger to depress one key, an adjacent key is inadvertently depressed at the same time, thereby causing data entry errors. This key-crowding problem is tolerated on miniature data processing devices, such as watch-calculator devices, where there simply is not much available room to space the keys apart from one another by distances sufficient to avoid the aforementioned problem of inadvertently depressing two keys at a time. The too-close spacing of the keys is also tolerated on larger devices where there is a design requirement for a multitude of alpha-numeric and function keys, such as on a computer-type typewriter-like keyboard, where there is insufficient room available to accommodate all such keys on a reasonably-sized keyboard housing unless all such keys are crowded together.

The key-crowding problem is typically dealt with in the art by either designing the keyboard housing to be oversized, or, in those applications where the keyboard housing must be of miniature size, e.g. in a watch-calculator device, by providing the user with a stylus to reliably depress one key at a time. This, however, is not a practical solution, because the stylus is often misplaced and not available for use when necessary. Many users resort to using a ballpoint pen or pencil to depress keys on a watch-calculator device, and often the resulting ink and pencil smears create a mess.

SUMMARY OF THE INVENTION

1. Objects of the Invention

It is a general object of this invention to avoid the aforementioned key-crowding problems of the prior art data processing devices.

It is another object of this invention to reliably and accurately enter data into a data processing device, particularly one of miniature dimensions.

It is a further object of this invention to reliably avoid the problem of inadvertently depressing more than one key at a time.

Still another object of this invention is to avoid the prior art necessity of providing a stylus for manually entering data on key-crowded keyboards, and the concomitant problems of misplacing the stylus and creating a mess when writing instruments are substituted for such styli.

Yet another object of this invention is to avoid the problem of having to design keyboards of larger size than necessary.

2. Features of the Invention

In keeping with these objects, and others which will become apparent hereinafter, one feature of this invention resides, briefly stated, in a novel keyboard for manually entering data into a data processing device, as well as the device itself having such keyboard.

The keyboard comprises a plurality of key assemblies mounted on the device, the key assemblies being manually actuatable for entering data to be processed. Each key assembly includes an elongated arm having an outer end region. A touch contact is provided at each outer end region for actuating a respective key assembly when the respective touch contact is engaged by a user.

The arms are mounted on the device for movement between a retracted position in which the touch contacts are situated along a first annulus having a predetermined diameter, and an extended position in which the arms are extended in a radial, starbust-like, tentacular pattern generally resembling the spokes of a wheel. In such extended position, the touch contacts are equiangularly arranged along a second annulus having a diameter larger than said predetermined diameter, as a result of which, each adjacent pair of touch contacts is spaced apart from the others by an angular distance sufficient to enable a finger of the user to engage one touch contact at a time without simultaneously engaging the adjacent touch contact.

Where the data processing device is advantageously a watch-calculator device having a casing with a circular periphery, the touch contacts are situated close to the periphery of the casing in the retracted position, and are spaced much further from the periphery of the casing in the extended position. This invention, however, is not intended to be limited to watch-calculator devices, but, instead, may be used for any wrist-wearable device, electronic games, walkie-talkies, pocket-sized computers, write-telephones, etc.

In accordance with this invention, the touch contacts in the retracted position cannot be readily actuated and, when the user desires to enter data into the device, it is necessary to move the touch contacts to the extended position wherein the individual keys may be reliably and accurately engaged without depressing more than one key at a time. Styli are no longer necessary, since the keys are spaced sufficiently far apart from one another. At the same time, the housing or casing of the device need not be oversized to accommodate a multitude of keys.

Another advantageous feature of this invention resides in the provision of synchronizer means mounted on the device for jointly moving all of the arms at the same time between the retracted and the extended positions. Advantageously, the synchronizer means is embodied in a ring mounted for turning movement on the housing. A set of projections extends from the ring into the path of movement of the arms between the retracted and the extended positions. The number of projections corresponds to the number of arms. By moving the ring in one circumferential direction, the arms will be moved to the extended position and, when the ring is moved in the opposite circumferential direction, the arms will be moved to the retracted position. Manual turning of the ring may be facilitated by providing the ring with an outer knurled surface. It is further advantageous if each projection lies in a plane which defines an acute angle with respect to a plane in which a respective arm lies when the latter is in the retracted position.

In one preferred embodiment of this invention, each touch contact constitutes a manually-depressible switch mounted at the outer end region of the respective arm.

Each switch, when depressed, is switchable between electrically open and closed states. An electrical conductor extends from each switch lengthwise along the respective arm to data processing means advantageously accommodated in a housing for the device.

In another advantageous embodiment, each arm is displaceable in a direction transverse to the movement between the extended and the retracted positions. In this case, each outer end region of the arms constitutes the touch contact for the respective arm. Each key assembly includes a switch mounted on a housing for the device. Each switch is situated in the path of transverse displacement of each arm. In response to manual urging against the outer end region of each arm, i.e. the touch contact itself, along said transverse direction, the arm acts as a lever and switches the respective switch between electrically open and closed states.

In a preferred construction, the arms at least partially circumferentially overlap one another in the retracted position. Each arm may be made of a rigid, shape-retaining material and be curved. Alternatively, each arm may be made of a flexible material which is bent into a curved shape in the retracted position. In the extended position, the curved arms extend both radially outwardly and at least partially circumferentially so that, in toto, they roughly resemble the tentacles of an octopus.

Yet another modification of the synchronizer means is embodied in forming the same as a planetary gear which meshingly engages satellite sector gears respectively provided at the inner end region of each arm.

The novel features which are considered as characteristic of the invention are set forth in particular in the appended claims. The invention itself, however, both as to its construction and its method of operation, together with additional objects and advantages thereof, best will be understood from the following description of specific embodiments when used in connection with the accompanying drawings.

BRIEF DESCRIPTION OF THE DRAWINGS

FIG. 7 is a side view of a watch-calculator device in accordance with a modification of this invention;

FIG. 8 is a bottom plan broken-away view taken on line 8—8 of FIG. 7;

FIG. 9 is a broken-away view of a data processing unit in accordance with still another modification of this invention, with the keyboard in retracted position;

FIG. 10 is a broken-away view of the modification of FIG. 9, with the keyboard in extended position;

FIG. 11 is an enlarged sectional view taken on line 11—11 of FIG. 10;

DETAILED DESCRIPTION OF THE PREFERRED EMBODIMENTS

Figure 1:
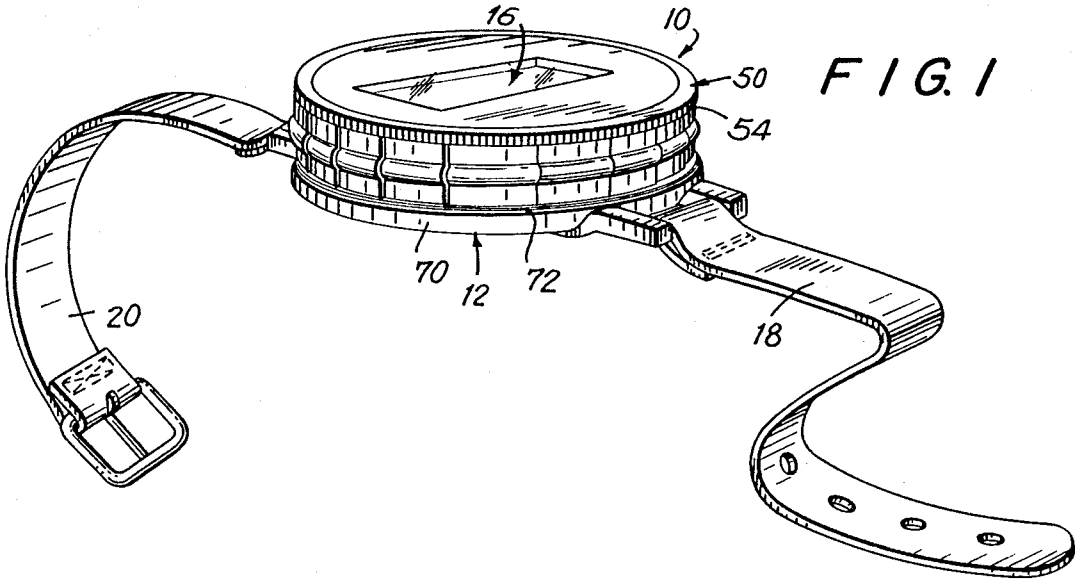
FIG. 1 is a perspective view of a watch-calculator data processing device having a keyboard in accordance with this invention, in the retracted position.

Referring now to the drawings, reference numeral 10 generally identifies an electronic data processing device for processing data to be manually entered. For ease of illustration and description, the device 10 is shown as a watch-calculator, but it will be expressly understood that any data processing device requiring manual data entry could incorporate the invention. By way of non-limiting example, such devices include any wrist-wearable or body-supportable device, pocket-sized computer, electronic hand-held game, walkie-talkie, write-telephone, etc.

The watch-calculator device 10 includes a housing or circular casing 12 bounding an interior 14 in which data processor electronics are located. In the case of a watch-calculator, the electronics are entirely conventional, and have not been described since they form no part of this invention. A conventional watch-calculator display 16 displays the processed data. A wrist strap including conventional belt portions 18, 20 is used in well-known manner to mount the device 10 on a user's wrist.

As noted previously, this invention is embodied in a keyboard for manually entering data into the data processor electronics for electronically processing and eventually displaying the processed results on the display 16. The keyboard includes a number of key assemblies, representative ones of which have been identified by reference numeral 24. The key assemblies 24 are best shown in a ready-to-use keyboard position illustrated in FIG. 2. There are about sixteen to twenty key assemblies mounted on the housing 12, in the preferred embodiment. Each key assembly 24 is manually actuatable for entering data such as a numeral or a function of the type conventionally found on calculator keyboards. The entered data could also be an alphabetic character of the type used on conventional computer keyboards. Each key assembly includes an elongated arm, representative ones of which being identified by reference numeral 26. Each arm has an inner end region 28 (see FIG. 3), and an outer end region 29 (see FIG. 2). A touch contact 30 is provided at each other end region of the arms. The contact 30 is operative for actuating a respective key assembly when the respective contact 30 is engaged by the user.

Figure 2:
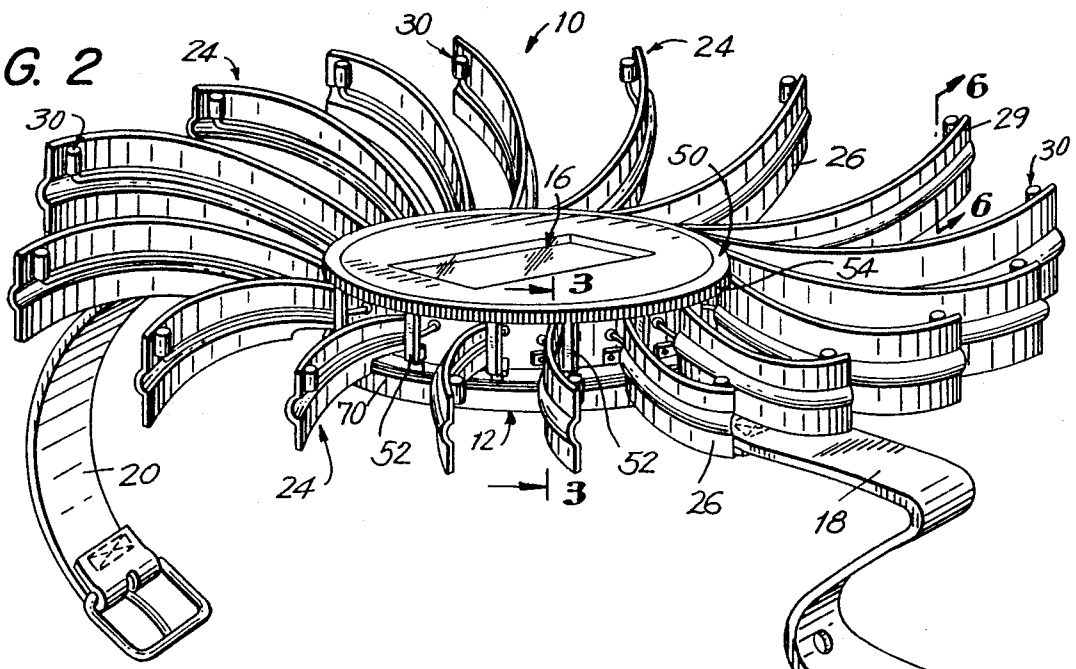
FIG. 2 is a view analogous to FIG. 1, but with the keyboard in the extended position.

The arms are mounted on the housing 12 for movement between a retracted or storage position, shown in FIG. 1, in which the touch contacts 30 are situated along a first annulus close to and, in fact, within, the circular periphery of the housing 12, and an extended or ready-to-use keyboard position, shown in FIG. 2, in which the arms are extended beyond the periphery of the housing 12 in an outwardly radial, starburst-like, tentacular pattern. The first annulus has a predetermined diameter roughly close to the diameter of the housing 12. In the extended position, the touch contacts 30 are equi-angularly arranged along a second annulus having a diameter larger than the diameter of the first annulus. The second annulus circumscribes the circular periphery of the housing, and is concentric with the first annulus. In the extended position, the contacts 30 are spaced so far apart from one another that the angular distance between each adjacent pair of contacts is sufficient to enable a forefinger of the user to engage one contact at a time without simultaneously engaging an adjacent contact. This angular distance is preferably on the order of ½" and larger. Risk of data entry errors is thereby reliably avoided.

In the embodiment illustrated in FIGS. 1–6, each arm is curved, and made of a shape-retaining, rigid, e.g. metallic, material. Hence, in the retracted position, the arms at least partially circumferentially overlap one another. In the extended position, the arms extend both radially outwardly and at least partially in the circumferential direction, and resemble, as previously described, the tentacles of an octopus.

Figure 6:
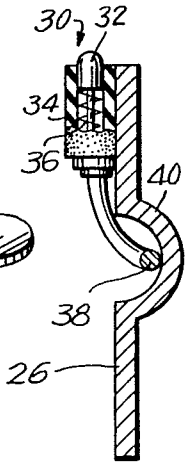
FIG. 6 is an enlarged sectional view taken on line 6—6 of FIG. 2.
Figure 5:
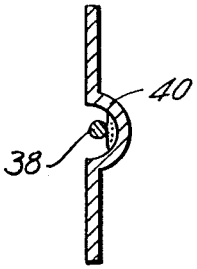
FIG. 5 is an enlarged sectional view taken on line 5—5 of FIG. 3.

Each touch contact 30, in the embodiment of FIGS. 1–6, is constituted by a manually-depressible switch of the momentary-action type. As best shown in FIG. 6, each switch 30 includes an armature 32 having an upper surface extended above the arm 26 so as to be readily accessible to the user without undue mechanical interference therewith, a stationary switch housing 34 fixedly mounted to the outer end region 29 of the arm, and a spring 36 operative to constantly urge the armature 32 to its readily-accessible raised position. By depressing the armature 32, the switch 30 is switched in conventional manner between electrically open and closed states. A conductor 38 of round cross-section is connected between each switch 30, and extends lengthwise of the respective arm to and past the inner end region 28 thereof to the data processor within the housing. The data processor, of course, detects the open or closed state of the respective switch, and processes this information in conventional manner. Advantageously, each round conductor 38 is acommodated, and securely held by means of an adhesive, in a channel 40 of generally U-shaped cross-section running lengthwise of each arm.

The movement of each arm between extended and retracted positions is facilitated by providing a pair of integral stub shafts 42, 44 at the inner end region 28 of each arm. The stub shafts are respectively journaled in corresponding bearings provided in a bottom plate 46 and a top plate 48, respectively, of the housing 12. Alternatively, a single pivot pin may be used to pivotably mount each arm on the housing. Another option is to form each arm of flexible material and form a living hinge at each inner end region (see FIGS. 9 and 10).

Although it is possible for the user to move each arm or adjacent groups of arms, in turn, from the retracted to the extended position in a manual manner, i.e. by hooking one's fingernail underneath the outer end region of each arm and pulling the thus-hooked arm outwardly, it is more convenient and advantageous if a synchronizer means, e.g. ring 50, is provided for jointly and simultaneously moving all of the arms together as a group between the retracted and the extended positions. The ring 50 is mounted on the housing for turning movement in either circumferential direction. A set of projections, representative ones of which have been designated by the reference numeral 52, project downwardly from the ring 50 into the path of movement of the arms between the extended and retracted positions. At least one projection is provided for each arm. The projections are equi-angularly arranged about thie circular periphery of the ring. The ring 50 is provided with an outer knurled or ribbed surface 54 to facilitate manual turning. Each projection 52 has a generally planar configuration, and lies in a plane that includes a slight acute angle, i.e. 15°, with a plane in which a respective arm, which likewise advantageously hs a generally planar shape, lies in the retracted position.

Figure 4:
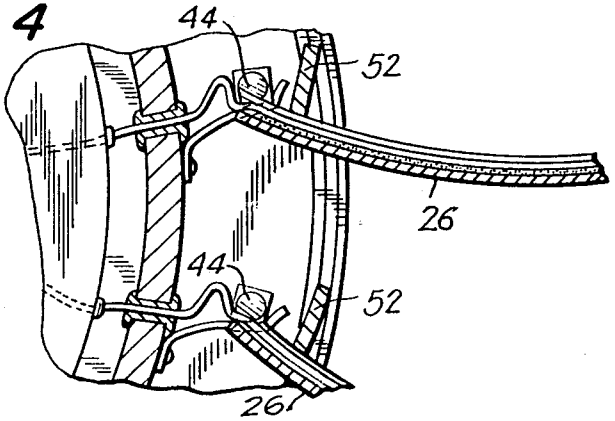
FIG. 4 is an enlarged sectional broken-away view taken on line 4—4 of FIG. 3.

In the extended position, as best shown in FIG. 4, each projection 52 lies at an approximate right angle to the plane of the respective arm. Turning of the ring in one circumferential direction, e.g. clockwise, causes the arms to be simultaneously deployed from the retracted to the extended position. Turning of the ring in the opposite circumferential direction, e.g. counterclockwise, causes the arms to be returned to the retracted position.

Referring now to the embodiment of FIGS. 7 and 8, rather than mounting the switches 30 at the outer end regions of the arms, this embodiment proposes fixedly mounting the switches 30 in an annulus on the device housing itself. In this case, each arm serves as an actuating lever to actuate a respective key assembly. The outer end region 29 itself of each arm 26 constitutes the touch contact 30 which, upon engagement by the user, actuates a respective key assembly. Thus, each arm is advantageously mounted for displacement from the solid line to the phantom line position illustrated in FIG. 7 in the direction of arrow A transverse to the aforementioned movement between the extended and retracted positions. In response to manual urging against the outer end region 29 of each arm 26 along this transverse direction, the respective arm pivots. Concomitantly, the inner end region 28 of the pivoting arm depresses the respective switch 30 on the housing. Hence, in a broader sense, it is merely necessary to locate the armature or at least one actuatable part of each key assembly at the aforementioned second annulus further from the housing. The remaining parts of each key assembly can be mounted on the arm itself and/or on the housing.

Referring now to the embodiment of FIGS. 9–11, rather than constituting each arm of a shape-retaining material, the arms may be made of a flexible, preferably synthetic plastic, material. As shown in FIG. 9, the arms are deformed and bent into a circumferentially overlapping condition by the synchronizer means whose projections maintain the arms in said bent condition. When the synchronizer ring is turned in the direction of arrow B, the projections 52 will urge the flexible arms away from their overlapping state, and free them to assume an extended position in which the arms extend solely in a radial direction from a common center.

The embodiment of FIGS. 9–11 also shows that the arms need not be provided with a channel for a round conductor, but, instead, as specifically shown in FIG. 11, each arm may have a generally planar cross-section, and the conductor 60 may likewise have a flattened cross-section. Rather than providing spring-biased switches of the type exemplified and illustrated in FIG. 6, this invention also proposes the use of rubber keys 62 impregnated with a conductive powder. Analogous to spring-biased switch 30, the powder-impregnated rubber switch is manually depressible and switchable between electrically open and closed states. The flat wire conductor 60 connected between each such rubber key 62 and the data processing electronics in the housing provide for a more compact assembly.

Figure 3:
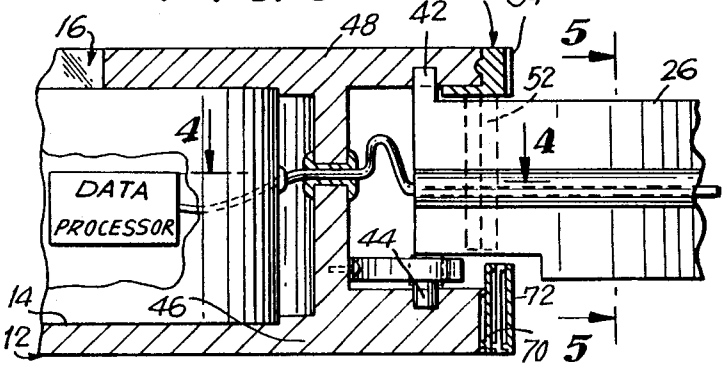
FIG. 3 is an enlarged sectional broken-away view taken on line 3—3 of FIG. 2.

Another feature resides in a shield for covering the arms in the retracted position. The shield includes a set of annular, slightly conically-tapered, telescoping sections 70, 72 mounted on the bottom wall 46 of the housing. As best shown in FIG. 3, the sections 70, 72 are mutually nested in a lowered position and do not obstruct movement of the arms. By grasping and pulling upwardly on outermost section 72, the outermost section is moved to, and is frictionally maintained in, a raised, shielded position in which the outermost section shields the arms in the retracted position. The shield helps prevent entry of contaminants into the housing, and also imparts a more finished, esthetic appearance to the device. By pushing down on section 72, it is returned to its lowered position.

Figure 12:
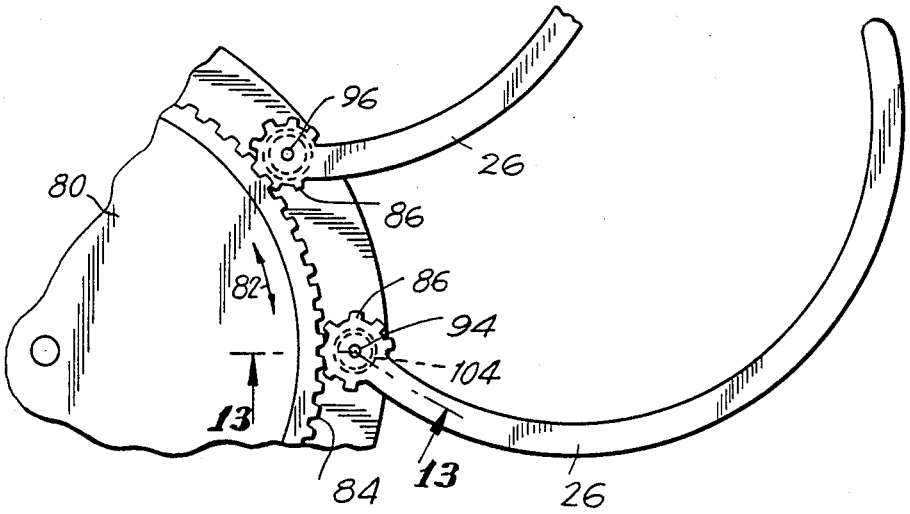
FIG. 12 is an enlarged broken-away plan view of yet another modification of this invention.
Figure 13:
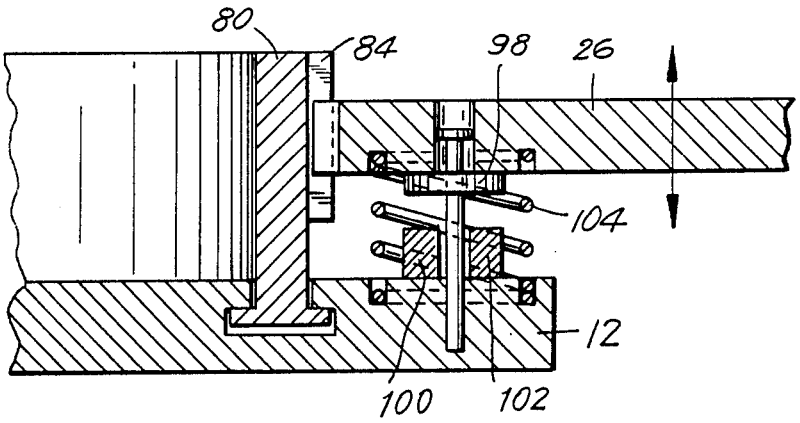
FIG. 13 is a broken-away sectional view taken on line 13—of FIG. 12.

FIGS. 12 and 13 show a modification of the synchronizer means, wherein the aforementioned projections are not needed. Instead, the synchronizer means is fachioned as a planetary gear 80 mounted for turning movement in either circumferential direction in the directions of double-headed arrow 82 in FIG. 12. The entire circular periphery of gear 80 has equidistantly spaced-apart gear teeth 84. At the inner end region of each arm is formed a satellite sector gear, e.g. 86 or 88, each having teeth 90, 92 respectively meshingly engaging with the teeth 84 at different equidistantly spaced-apart locations around the periphery of gear 80. Turning of the gear 80 in one direction causes the arms to be pivoted about respective pivot axles, e.g. 94 or 96, to the extended position. Turning of the gear 80 in the opposite direction returns the arms to the retracted position. The geared engagement between the arms and the synchronizer means provides for a more precise tracking control and a better mechanical "feel" during movement of the arms.

As best shown in FIG. 13, once arm 26 is in the extended position, the outer end region of the arm can be depressed, thereby moving the inner end region of the arm 26 downwardly toward the housing 12. As described previously in the embodiment of FIGS. 7 and 8, switches may be provided around the periphery of the housing, in which case, the arms act as levers to actuate their associated switches. Each switch in the FIG. 13 embodiment comprises an upper bridging member 98 which, when brought into bridging conductive contact across leads 100, 102, completes an electrical circuit. A return spring 104 returns the arm 26 to its original state.

It will be understood that each of the elements described above, or two or more together, also may find a useful application in other types of constructions differing from the types described above.

While the invention has been illustrated and described as embodied in a keyboard for miniature data processing devices, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

What is claimed is:

1. A device for processing data to be manually entered, comprising:

(a) a housing having an interior in which data processing means are located, and a periphery; and (b) keyboard means including a plurality of key assemblies mounted on the housing and manually actuatable for entering data to be processed, each key assembly including an elongated arm having an outer end region, a switch, and a touch contact at each outer end region for actuating a respective switch when the respective touch contact is engaged by a user, (i) said arms being mounted on the housing for movement between a retracted position in which the touch contacts are situated close to the periphery of the housing, and an extended position in which the arms are extended beyond the periphery of the housing in a radial pattern in which the touch contacts are equiangularly arranged along an annulus circumscribing the periphery of the housing and spaced apart from each other by an angular distance sufficient to enable a finger of the user to engage one touch contact at a time without simultaneously engaging an adjacent touch contact, and (ii) each arm being displaceable in a direction transverse to said movement between the extended and retracted positions in response to manual urging against the respective touch contact along said transverse direction to actuate a respective switch.

2. The device as recited in claim 1, wherein each arm has an inner end region hinged to the housing for movement about a respective hinge axis between the extended and retracted positions.

3. The device as recited in claim 1, wherein said arms are movable in a common plane during said movement between the extended and retracted positions, and wherein the arms are displaceable along said transverse direction which extends generally perpendicular to said common plane.

4. A combination watch-calculator device for processing data to be manually entered, and for displaying the processed data, comprising:

(a) a casing having an interior in which data processing means are located, and a generally circular periphery;

(b) means for mounting the casing on a wrist of a user;

(c) keyboard means including a plurality of key assemblies mounted on the casing and manually actuatable for entering data to be processed, each key assembly including an elongated arm having an outer end region, and a touch contact at each outer end region for actuating a respective key assembly when the respective touch contact is engaged by a user, said arms being mounted on the casing for movement between a retracted position in which the touch contacts are situated close to the periphery of the casing along a first annulus having a predetermined diameter, and an extended position in which the arms are extended beyond the periphery of the casing in a radial pattern in which the touch contacts are equi-angularly arranged along a second annulus circumscribing the periphery of the casing and having a diameter larger than said predetermined diameter, the touch contacts being spaced apart from each other by an angular distance sufficient to enable a finger of the user to engage one touch contact at a time without simultaneously engaging an adjacent touch contact;

(d) means on the casing for displaying the processed data; and (e) synchronizer means on the casing for jointly and simultaneously moving all the arms between the retracted and the extended positions.

5. The device as recited in claim 4, wherein each touch contact constitutes a manually-depressible switch mounted at the outer end region of the respective arm, and operative for switching displacement between electrically open and closed states.

6. The device as recited in claim 5, wherein each key assembly includes an electrical conductor extending lengthwise along a respective arm from each switch to the housing.

7. The device as recited in claim 6, wherein each conductor has a round cross-section, and wherein each arm has a channel in which the round conductor is accommodated.

8. The device as recited in claim 6, wherein each conductor has a generally planar cross-section, and wherein each arm also has a generally planar cross-section.

9. The device as described in claim 4; and further comprising shielding means for shielding the arms in the retracted position.

10. A keyboard for manually entering data into a data processing device, comprising:

(a) a plurality of key assemblies on the device and manually actuatable for entering data to be processed each key assembly including an elongated arm having an outer end region, a switch, and a touch contact at each outer end region for actuating a respective switch when the respective touch contact is engaged by a user, (b) said arms being mounted on the device for movement between a retracted position in which the touch contacts are situated along a first annulus having a predetermined diameter, and an extended position in which the arms are extended in a radial pattern and in which the touch contacts are equiangularly arranged along a second annulus having a diameter larger than said predetermined diameter, the touch contacts being spaced apart from each other by an angular distance sufficient to enable a finger of the user to engage one touch contact at a time without simultaneously engaging an adjacent touch contact, and (i) each arm being displaceable in a direction transverse to said movement between the extended and retracted positions in response to manual urging against the respective touch contact along said transverse direction to actuate a respective switch.

11. The keyboard as recited in claim 10; and further comprising synchronizer means on the device, for jointly moving all the arms between the retracted and the extended positions.

12. The keyboard as recited in claim 10, wherein the arms at least partly circumferentially overlap one another in the retracted position.

13. The keyboard as recited in claim 11, wherein the synchronizer means includes a planetary gear mounted for turning movement on the housing, each of said arms having a satellite sector gear at an inner end region thereof, said planetary gear being in meshing engagement with esch satellite gear.

14. A device for processing data to be manually entered, comprising:

(a) a housing having an interior in which data processing means are located, and a periphery; and (b) keyboard means including a plurality of key assemblies mounted on the housing and manually actuatable for entering data to be processed, each key assembly including an elongated arm having an outer end region, and a touch contact at each outer end region for actuating a respective key assembly when the respective touch contact is engaged by a user, (i) said arms being mounted on the housing for movement between a retracted position in which the touch contacts are situated close to the periphery of the housing, and an extended position in which the arms are extended beyond the periphery of the housing in a radial pattern in which the touch contacts are equiangularly arranged along an annulus circumscribing the periphery of the housing and spaced apart from each other by an angular distance sufficient to enable a finger of the user to engage one touch contact at a time without simultaneously engaging an adjacent touch contact, (ii) each arm being displaceable in a direction transverse to said movement between extended and retracted positions in response to manual urging against the outer end region of the respective arm along said transverse direction, each outer end region constituting the touch contact for the respective arm, and (iii) each key assembly including a switch mounted on the housing and situated in the path of displacement of a respective arm, each switch being switchable between electrically open and closed states.

15. A device for processing data to be manually entered, comprising:

(a) a housing having an interior in which data processing means are located, and a periphery; and (b) keyboard means including a plurality of key assemblies mounted on the housing and manually actuatable for entering data to be processed, each key assembly including an elongated arm having an outer end region, and a touch contact at each outer end region for actuating a respective key assembly when the respective touch contact is engaged by a user, said arms being mounted on the housing for movement between a retracted position in which the arms at least partially circumferentially overlap one another, and the touch contacts are situated close to the periphery of the housing, and an extended position in which the arms are extended beyond the periphery of the housing in a radial pattern in which the touch contacts are equi-angularly arranged along an annulus circumscribing the periphery of the housing and spaced apart from each other by an angular distance sufficient to enable a finger of the user to engage one touch contact at a time without simultaneously engaging an adjacent touch contact.

16. The device as recited in claim 15, wherein each arm is made of a shape-retaining material and is curved.

17. The device as recited in claim 15, wherein each arm is made of a flexible material.

18. A device for processing data to be manually entered, comprising:

(a) a housing having an interior in which data processing means are located, and a periphery;

(b) keyboard means including a plurality of key assemblies mounted on the housing and manually actuatable for entering data to be processed, each key assembly including an elongated arm having an outer end region, and a touch contact at each outer end region for actuating a respective key assembly when the respective touch contact is engaged by a user, said arms being mounted on the housing for movement between a retracted position in which the touch contacts are situated close to the periphery of the housing, and an extended position in which the arms are extended beyond the periphery of the housing in a radial pattern in which the touch contacts are equi-angularly arranged along an annulus circumscribing the periphery of the housing and spaced apart from each other by an angular distance sufficient to enable a finger of the user to engage one touch contact at a time without simultaneously engaging an adjacent touch contact; and (c) synchronizer means mounted on the housing, for jointly moving all of the arms between the retracted and the extended positions.

19. The device as recited in claim 18, wherein the synchronizer means includes a planetary gear mounted for turning movement on the housing, each of said arms having a satellite sector gear at an inner end region thereof, said planetary gear being in meshing engagement with each satellite gear.

20. The device as recited in claim 18, wherein the synchronizer means includes a ring mounted for turning movement on the housing, and a set of projections extending from the ring into the path of movement of the arms between the retracted and the extended positions, the number of projections corresponding to the number of arms.

21. The device as recited in claim 20, wherein the ring has an outer knurled surface to facilitate manual turning, and wherein each projection lies in a plane that includes an acute angle with a plane in which a respective arm lies in the retracted position.

* * * * *